United States Patent [19]

Siwiak et al.

[11] 4,442,438

[45] Apr. 10, 1984

[54] HELICAL ANTENNA STRUCTURE CAPABLE OF RESONATING AT TWO DIFFERENT FREQUENCIES

[75] Inventors: Kazimierz Siwiak, Sunrise; Oscar M. Garay, North Lauderdale; Quirino Balzano, Plantation, all of Fla.

[73] Assignee: Motorola, Inc., Schaumburg, Ill.

[21] Appl. No.: 363,186

[22] Filed: Mar. 29, 1982

[51] Int. Cl.[3] ..... H01Q 1/36

[52] U.S. Cl. ..... 343/792; 343/895

[58] Field of Search ..... 343/792, 895

[56] References Cited

U.S. PATENT DOCUMENTS

| | | | |
|---|---|---|---|
| 1,911,234 | 3/1930 | Meyer | 343/823 |
| 2,802,210 | 5/1955 | Berndt | 343/792 |
| 2,953,786 | 6/1958 | Krause | 343/895 |
| 3,623,113 | 8/1969 | Faigen et al. | 343/747 |
| 3,818,488 | 1/1973 | Majkrzak et al. | 343/895 |
| 3,932,873 | 9/1974 | Garcia | 343/895 |
| 3,961,332 | 7/1975 | Middlemark | 343/802 |
| 4,229,743 | 9/1978 | Vo et al. | 343/895 |

*Primary Examiner*—Eli Lieberman

*Attorney, Agent, or Firm*—Mark P. Kahler; Edward M. Roney; James W. Gillman

[57] ABSTRACT

An antenna is provided which exhibits a relatively small size and is capable of resonating at two different frequencies. The antenna includes two helically wound elements which resonate at a first resonant frequency. A conductive member extends through and beyond one of the two helical elements to cause the antenna to resonate at a second resonant frequency.

8 Claims, 8 Drawing Figures

HELICAL ANTENNA STRUCTURE CAPABLE OF RESONATING AT TWO DIFFERENT FREQUENCIES

BACKGROUND OF THE INVENTION

This invention relates to antenna structures and, more particularly to antenna structures capable of resonating at two different frequencies.

DESCRIPTION OF THE PRIOR ART

In the past, large antennas such as the half-wave dipole depicted in FIG. 1A were quite acceptable as antennas for low frequency fixed station transceivers. Unfortunately, with the advent of portable transceivers operating at relatively high frequencies, such as ultra-high frequency 800 MHz, the large size of such half-wave dipole antennas with respect to the relatively small size of the portable transceiver makes such dipole antennas impractically large for employment on such a transceiver. However, if a full size half-wave dipole could be employed with such small ultra-high frequency portable transceivers it would have the advantage of a relatively large impedance bandwidth as shown in the return loss vs. frequency graph of FIG. 1B. Unfortunately, the size of such an antenna is simply too large to be aesthetically acceptable with respect to the modern relatively small portable transceivers on which it would be situated.

One solution to the above antenna size problem which permits reduction of the length of the full size half-wave dipole antenna of FIG. 1A is to form each of the two quarter wave length ($\lambda/4$) elements of such half-wave dipole antenna into respective helices resulting in the antenna shown in FIG. 2A. Each helix thus formed occupies considerably less room ($\lambda'/4$) than the corresponding element of the dipole of FIG. 1A, but desirably exhibits the same effective electrical length. Although such a structure does indeed result in a reduction in size of the antenna to be employed on a portable radio, the usable bandwidth of such a helical antenna as shown in FIG. 2A is greatly reduced when compared to the full size dipole antenna of FIG. 1A. This reduction in usable bandwidth is readily appreciated by an examination of the typical return loss vs. frequency graph shown in FIG. 2B. Such graph shows a rather sharp peak in return power loss at 810 MHz and thus such helical antenna of FIG. 2B is usable for operating in only a relatively narrow bandwidth centered around 810 MHz and thus would not be suitable for a transceiver operating at two frequencies.

It is one object of the present invention to provide an antenna exhibiting a size sufficiently small to be employed with modern relatively high frequency portable radios.

Another object of the present invention is to provide such a small size antenna which exhibits a relatively wide bandwidth.

Another object of the invention is to provide such a small size antenna which is capable of resonating on two different frequencies.

These and other objects of the invention will become apparent to those skilled in the art upon consideration of the following description of the invention.

BRIEF SUMMARY OF THE INVENTION

The present invention is directed to providing an antenna exhibiting first and second different predetermined resonant frequencies.

In accordance with one embodiment of the invention, the antenna includes a first helically configured electrically conductive element and a second helically configured electrically conductive element. Such first and second elements are coupled to a common feed port so as to resonate together at the first predetermined resonant frequency when radio frequency energy is supplied to the feed port. The antenna includes a first electrically conductive member having first and second portions. The first portion is situated within the first element. The second portion is situated external to the first element and extends from the first portion. The first member is coupled to the feed port and the first element such that the first member and the first element together resonate at the second predetermined resonant frequency when radio frequency energy is supplied to the feed port.

The features of the invention believed to be novel are set forth with particularity in the appended claims. The invention itself however, both as to organization and method of operation, together with further objects and advantages thereof, may best be understood by reference to the following description taken in conjunction with the accompanying drawings.

DETAILED DESCRIPTION OF THE PREFERRED EMBODIMENT

Figure 1A:
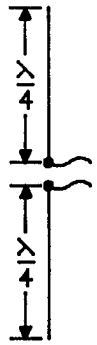
PRIOR ART Fig. 1a
FIG. 1A is a representation of a conventional full size half-wave dipole antenna.
Figure 1B:
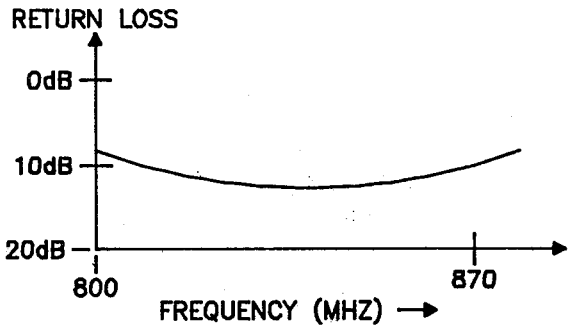
PRIOR ART Fig. 1b
FIG. 1B is a return loss vs. frequency graph of the antenna of FIG. 1A.
Figure 2A:
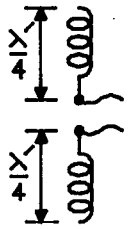
PRIOR ART Fig. 2a
FIG. 2A is a representation of a half-wave length helical dipole.
Figure 2B:
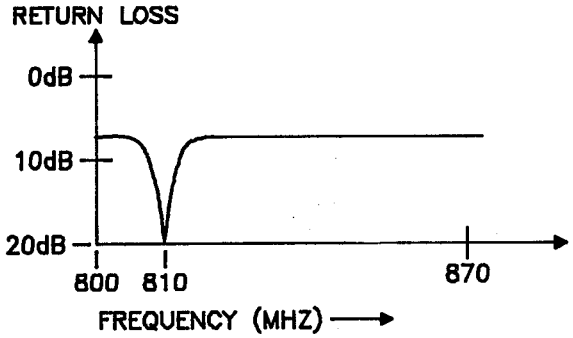
PRIOR ART Fig. 2b
FIG. 2B is a return loss vs. frequency graph of the antenna of FIG. 2A.
Figure 3:
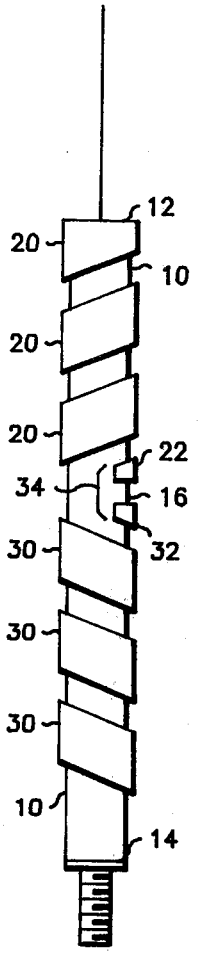
FIG. 3 is a side view of the antenna of the present invention.

FIG. 3 illustrates one embodiment of the antenna of the present invention. The antenna of FIG. 3 includes a substantially cylindrical support member or separating element 10 having opposed ends 12 and 14 and a middle portion 16. Support member 10 is comprised of an electrically insulative material such as polyfoam, plastic, glass or the like. An element 20 of electrically conductive material is wound around the portion of support member 10 between end 12 and center portion 16 in the helical configuration depicted in FIG. 3. A material such as copper ribbon for example may be employed as helical element 20. An element 30 of electrically conductive material is wound around the portion of support member 10 between end 14 and center 16 in the helical configuration shown in FIG. 3. The rotation of this configuration may be seen to be opposite to that of element 20, however in other embodiments of the invention the rotation of element 30 may be the same as that of element 20. A metallic ribbon comprised of copper, for example, is suitable for the material employed to fabricate helically wound element 30. The portion of helical element 20 closest to center 16 is designated center feed point 22. The portion of helical element 30 closest to center 16 is designated center feed point 32. Feed point 22 and feed point 32 together comprise feed port 34.

Figure 4:
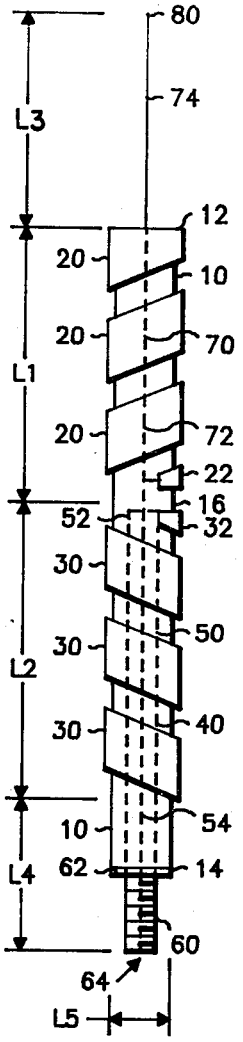
FIG. 4 is a side view of the antenna of the present invention showing the internal components thereof.

FIG. 4 is now referred to for discussion of electrical connections which are made internal to the antenna of the invention of FIG. 3 which are not shown in such side view thereof. It is noted that like numbers represent like components in FIGS. 3 and 4. In FIG. 4, it is seen that support member 10 includes a cylindrically shaped cavity 40 extending between center feed point 32 and end 14 along the central vertical axis of support member 10. Cavity 40 is shaped to receive a length of coaxial cable 50 therein which extends between center feed point 32 and end 14. Coaxial cable 50 includes a shield 52 having one end thereof electrically connected to center feed point 32 in the manner of FIG. 4 and having the remaining end thereof near end 14 electrically connected to the ground portion 62 of a coaxial connector base mounting 60. Coaxial cable 50 further includes a center conductor 54 having one end thereof electrically connected to a center conductor portion 64 of coaxial mounting base 60. The remaining end of center conductor 54 is electrically connected to center feed point 22 and to a member 70 of electrically conductive material which is situated within support member 10 at the center thereof extending along the length of the vertical axis thereof from support center 16 to a point 80 external to support member 10. The portion of conductive element 70 internal to support 10, that is between end 12 and center 16 is designated portion 72 and is indicated by a dashed line along the central vertical axis of support 10. The portion of conductive element 70 external to support 10 is designated portion 74 and extends between end 12 and point 80. Portion 74 is situated along the same central vertical axis of support 10 as portion 72 and by nature of being a part of conductive element 70 is connected to portion 72 at end 12. It is noted that by virtue of their already discussed locations on support member 10, helical elements 20 and 30 are aligned to share a common central axis.

It is additionally noted that support member 10 separates and electrically insulates coaxial cable 50 from helically wound element 30 and further separates and insulates portion 72 from helically wound element 20 while simultaneously providing structural integrity to the antenna apparatus of the present invention shown in FIG. 4.

Figure 5:
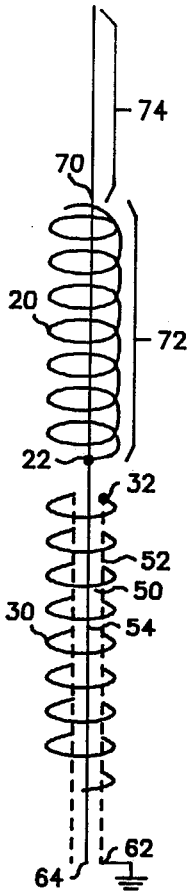
FIG. 5 is a schematic representation of the antenna of the present invention.

FIG. 5 is a simplified representation of the antenna of the present invention of FIGS. 3 and 4 wherein like numbers indicate like components.

Figure 6:
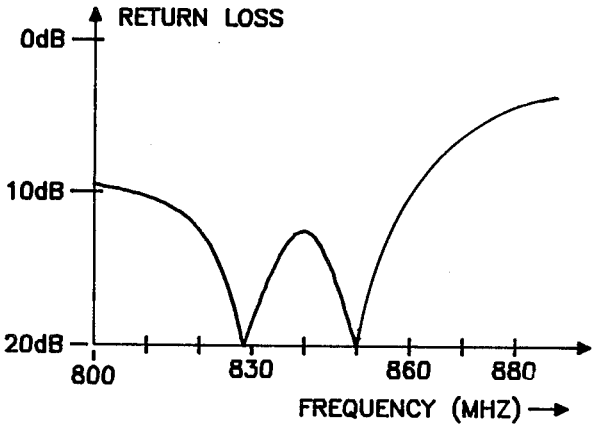
FIG. 6 is a return loss vs. frequency graph of the antenna of the present invention.

In one embodiment of the present invention, the antenna structure of FIG. 4 yields a return loss vs. frequency graph such as that shown in FIG. 6 wherein such antenna resonates at two different frequencies, namely at approximately 827 MHz and approximately 850 MHz, thereby resulting in a total usable bandwidth of 55 MHz between approximately 805 MHz and 860 MHz where this range is determined by the return loss not being less than approximately 10 dB. The dimensions of the antenna of FIG. 4 used to achieve this dual resonance-wide bandwidth effect are discussed subsequently.

Referring again to FIG. 4, the length of helically wound element 20 is defined to be L1 and in this embodiment is equal to approximately 1.65 inches. The length of helically wound element 30 is defined to be L2 and is equal to approximately 1.75 inches in this embodiment. When fed with radio frequency energy by center feed points 22 and 32, (that is, at feed port 34 as shown in FIG. 3) helically wound elements 20 and 30 respectively cooperate to cause the antenna of FIG. 4 to resonate at approximately 827 MHz.

The length of portion 74 extending between end 12 and point 80 external to support structure 10 is designated L3 and is equal to approximately 1.40 inches in this embodiment of the invention. When the antenna of FIG. 4 is fed with radio frequency energy at center feed points 22 and 32 (feed port 34) via center conductor portion 64 and ground portion 62 connected respectively thereto, conductive element 70 (including internal portion 72 and external portion 74 thereof) and helically wound element 20 (all exhibiting the appropriate dimensions already discussed) cooperate to cause the antenna of FIG. 4 to exhibit a second resonance at a frequency of approximately 850 MHz as seen in the return loss vs. frequency graph of FIG. 6. In this embodiment of the invention, the distance between the end of helically wound element 30 facing end 14 and the lowermost portion of coaxial connector 60 is designated L4 and is approximately 0.85 inches. The width of the antenna of the antenna of FIG. 4 is designated L5 and in this embodiment is approximately 0.40 inches.

The foregoing describes an antenna which exhibits a relatively small size and yet achieves a relatively wide bandwidth by virtue of exhibiting two resonant frequencies. Those skilled in the art will appreciate that the two frequencies at which the antenna of the present invention resonates and the amount of bandwidth therebetween may be varied by correspondingly varying the aforementioned dimensions of the antenna. Furthermore, those skilled in the art will appreciate that the various elements of the antenna of the present invention can be appropriately scaled up or down in dimension so as to operate at frequency bands other than the 800 MHz band embodiment discussed above for purposes of example.

While only certain preferred features of the invention have been shown by way of illustration, many modifications and changes will occur to those skilled in the art. It is, therefore, to be understood that the present claims are intended to cover such modifications and the changes as fall within the true spirit of the invention.

What is claimed is:

1. An antenna exhibiting first and second different predetermined resonant frequencies comprising:

a first helically configured electrically conductive element;

a second helically configured electrically conductive element, said first and second elements being coupled to a common feed port so as to together resonate at said first predetermined resonant frequency when radio frequency energy is supplied to said feed port, and a first electrically conductive member including first and second portions, said first portion being situated within said first element, said second portion being situated external to said first element and extending from said first portion, said first member being coupled to said feed port and said first element such that said first member and said first element together resonate at said second predetermined resonant frequency when radio frequency energy is supplied to said feed port.

2. An antenna exhibiting first and second different predetermined resonant frequencies comprising:

a first helically configured conductive element having first and second opposed ends;

a second helically configured conductive element having first and second opposed ends, said first and second elements being aligned so as to share a common axis between the respective ends thereof, the first end of said first element being situated adjacent the first end of said second element to form adjacent ends each of which is coupled to a common feed port such that when radio frequency energy is applied thereto, said first and second element cooperate to resonate at said first resonant frequency, and a first conductive member including first and second portions each exhibiting a predetermined length, said first portion being situated within said first element along said axis thereof, said second portion extending from said first portion a predetermined distance beyond the second end of said first element, said first conductive member being coupled to the first end of said first element and to said feed port such that when radio frequency energy is applied to said feed port, said first conductive member and said first conductive element cooperate to resonate at said second resonant frequency.

3. The antenna of claim 2 including a coaxial feed line having a center conductor and a ground conductor situated within said second conductive element and running along said axis thereof between the first and second ends of said second conductive element, said center conductor being coupled to said first conductive member, said ground conductor being coupled to the first end of said second conductive element.

4. The antenna of claim 2 wherein said helically configured first and second conductive elements are comprised of metallic ribbon.

5. The antenna of claim 2 including first separation means disposed between the first portion of said first member and said first conductive element, for holding said first portion spatially separated from said first conductive element.

6. The antenna of claim 3 including second separation means, disposed between said coaxial feed line and said second conductive element, for holding said coaxial feed line spatially separated from said second conductive element.

7. The antenna of claim 5 wherein said first separation means is comprised of electrically insulative material.

8. The antenna of claim 6 wherein said second separation means is comprised of electrically insulative material.

* * * * *